US008162445B2

(12) United States Patent
Tajima et al.

(10) Patent No.: US 8,162,445 B2
(45) Date of Patent: Apr. 24, 2012

(54) INK JET PRINTING HEAD

(75) Inventors: Hiroki Tajima, Yokohama (JP); Minoru Nozawa, Yokohama (JP); Ryoichiro Kurobe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/537,756

(22) Filed: Aug. 7, 2009

(65) Prior Publication Data

US 2009/0295873 A1 Dec. 3, 2009

Related U.S. Application Data

(62) Division of application No. 11/477,351, filed on Jun. 30, 2006, now Pat. No. 7,591,527.

(30) Foreign Application Priority Data

Jul. 8, 2005 (JP) ..... 2005-200154
Jul. 8, 2005 (JP) ..... 2005-200155

(51) Int. Cl.
*B41J 2/05* (2006.01)

(52) U.S. Cl. ..... 347/58; 347/59

(58) Field of Classification Search ..... 347/58, 347/59

See application file for complete search history.

(56) References Cited

U.S. PATENT DOCUMENTS 5,637,166 A 6/1997 Swanson et al. ..... 156/73.1
5,701,147 A 12/1997 Nozawa
5,867,200 A 2/1999 Tajima et al.
6,273,536 B1 8/2001 Nozawa
6,502,927 B2 1/2003 Nozawa
2002/0051042 A1* 5/2002 Takagi et al. ..... 347/72
2002/0071002 A1 6/2002 Kawamura et al. ..... 347/50
2005/0012791 A1* 1/2005 Anderson et al. ..... 347/85
2005/0078143 A1 4/2005 Shimomura et al.
2006/0244797 A1 11/2006 Tajima

FOREIGN PATENT DOCUMENTS

JP 8-300687 11/1996
JP 2004-074679 3/2004
JP 2004-249709 9/2004

* cited by examiner

*Primary Examiner* — Laura Martin

(74) *Attorney, Agent, or Firm* — Fitzpatrick, Cella, Harper & Scinto

(57) ABSTRACT

An ink jet printing head is attachable to/detachable from an ink jet printing apparatus and includes an electric wiring member formed of a TAB tape to which terminals are provided, and has a wiring exposed through an end section of the electric wiring member, the terminals accepting signals by making contact with a connection portion on the part of the apparatus when the head is attached to the apparatus. An opening is provided in a supporting member which supports the electric wiring member, the opening extending in a direction traversing an area where the electric wiring member is supported. Thereby, movement of liquid, such as water and ink, to the end section is blocked, the liquid moving through a gap between a back surface of the electric wiring member and a surface of the supporting member.

11 Claims, 12 Drawing Sheets

INK JET PRINTING HEAD

This is a division of U.S. patent application Ser. No. 11/477,351, filed Jun. 30, 2006.

BACKGROUND OF THE INVENTION

1. Field of the Invention

The present invention relates to an ink jet printing head used in an ink jet printing apparatus which performs printing operations by ejecting liquid such as ink.

2. Description of the Related Art

There is a demand for an ink jet printing head mounted on the ink jet printing apparatus (hereinafter, also referred to as a "printer") to reduce costs of constituent parts thereof to facilitate manufacturing and assembling thereof, in order to inexpensively provide users with the printing head. Further, there is a demand for the printing head to decrease a number of parts thereof as much as possible also from environmental concerns.

Here, a print element substrate of the ink jet printing head, and an electric wiring member which is generally flexible so as to dispose on a casing of the ink jet printing head (or a casing of an ink jet cartridge) along a side surface thereof, are joined to each other by, for example, bonding or the like. In addition, as disclosed in Japanese Patent Application Laid-open No. 8-300687 (1996), the print element substrate and a back surface of the electric wiring member are fixed to the casing by adhesion or the like after having been aligned to a predetermined position of the casing. Here, also with respect to an area of the electric wiring member where electrical signal input terminals are disposed, the area is fixed to the casing by adhesion or the like after being bent along the side surface of the casing. On the other hand, the casing and a passage member are previously joined to each other by ultrasonic welding or the like. Thereafter, the absorbers are inserted, ink is injected into the absorbers, and the cover member is joined to the main body member, whereby an ink jet cartridge is completed.

The configuration as described above has an advantage that manufacturing costs are low because the number of parts is small, and because the printing head can be assembled in simple processes.

In the configuration of the printing head as described above, while the area of the electrical signal input terminal portion in the electric wiring member is fixed to the main body member by using the adhesive agent or the like, there are constraints on usable adhesive agents. More specifically, the adhesive agent needs to be selected in consideration of, for example, whether the adhesive agent matches well with ink, whether gas and the like are generated in a process where the adhesive agent cures, whether characteristics of the adhesive agent, curing conditions, and the like are suitable for achieving a target production tact, and the like. Additionally, there is such a problem as that, because an adhesion process is incorporated in manufacturing processes, the adhesion process necessitates a cost increase. For this reason, and also in view of cost reduction, it is preferable that use of the adhesive agent be avoided as much as possible.

For the above purpose, as a configuration using no adhesive agent, consideration can be made for a configuration where several points around the area of the electrical signal input terminal portion are fixed by heat caulking. In this case, however, the casing and the back surface of the electric wiring member cannot be completely attached firmly to each other, and a gap is generated therebetween. Such a gap can also be generated in a portion where adhesion is insufficient in a case of a conventional printing head using the adhesive agent.

On the other hand, there is a case where, on the side surfaces of the casing, drops of water are generated as a result of generation of dew condensation. Furthermore, there is a case where ink mist, which is generated through repetitive ink ejection from ink ejection openings, is accumulated in each portion of the printing head, and forms drops of ink. Moreover, operations (recovery operations) are sometimes performed on the printing head for maintaining, or for recovering, ink ejection performances in a favorable state. Specifically, the recovery operations include: a process for forcedly discharging ink from the ejection openings by causing a suction force and the like to act upon the ink; and a process for wiping a surface (ejection face), on which the ejection openings are provided, of the print element substrate. There is a case where, when these recovery operations are performed, ink attached to the ejection face, or ink wiped away by the wiping process moves toward the electric wiring member from a portion connected with the print element substrate. Subsequently, due to capillary force, liquid, such as ink and water drops, moves through a gap between a supporting surface of the casing and a supported surface of the electric wiring member. Thus, the liquid may possibly spread out along the area of the casing where the electric wiring member is arranged.

Incidentally, there is a case where the electric wiring member is formed by using a TAB tape in view of cost reduction. In this case, by punching a lengthy matrix of the TAB tape on which a wiring (including copper foil, and a plated part formed of Au, Ni, or the like, for protecting the copper foil) as a conductive member is formed, the TAB tape is processed into the electric wiring member having a desired shape and desired dimensions. Accordingly, the conductive wiring member is exposed through an end section of the TAB tape, the end section being located on a side of the area where the electrical signal input terminals for establishing electrical connection with the outside are disposed.

Accordingly, when liquid comes moving to this end section due to the capillary force, the exposed conductive member and the liquid make contact with each other, whereby there arises a risk of causing an electrical trouble, such as occurrence of an electrical short circuit, or corrosion of the wiring.

As a response to this problem, consideration can be made for adopting a configuration where an exposed portion of the conductive member in the end section of the electric wiring member is sealed with a sealing material. In this case, however, there arise the same problems as in the aforementioned case where the adhesive agent is used, and use of a sealing material is not preferable.

SUMMARY OF THE INVENTION

The present invention was made by taking the abovementioned issues into consideration, and aims at providing an ink jet printing head with a high electrical reliability at low cost, by effectively preventing inconveniences entailed in an incident where liquid, such as water drops and ink, comes moving to a portion, in which a conductive member is exposed, of an electric wiring member of the printing head, and the like.

In an aspect of the present invention, there is provided an ink jet printing head attachable to/detachable from an ink jet printing apparatus, comprising:

an ejection portion including ink ejection openings, and elements which generate energy for ejecting ink from the ink election openings;

a tape-formed electric wiring member provided with: external signal connection terminals which make contact with connection terminals of the ink jet print apparatus when the ink jet printing head is attached to the ink jet printing apparatus; terminals connected to the elements; and a wiring for transmitting signals including drive signals for the elements by connecting the terminals and the external signal connection terminals; and a supporting member, which supports the ejection portion and the electric wiring member, and which includes an opening extending in a direction traversing across an area where the electric wiring member is supported.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

The present invention will be described in detail below by referring to drawings.

1. Configuration Example of Ink Jet Printing Apparatus

Figure 1:
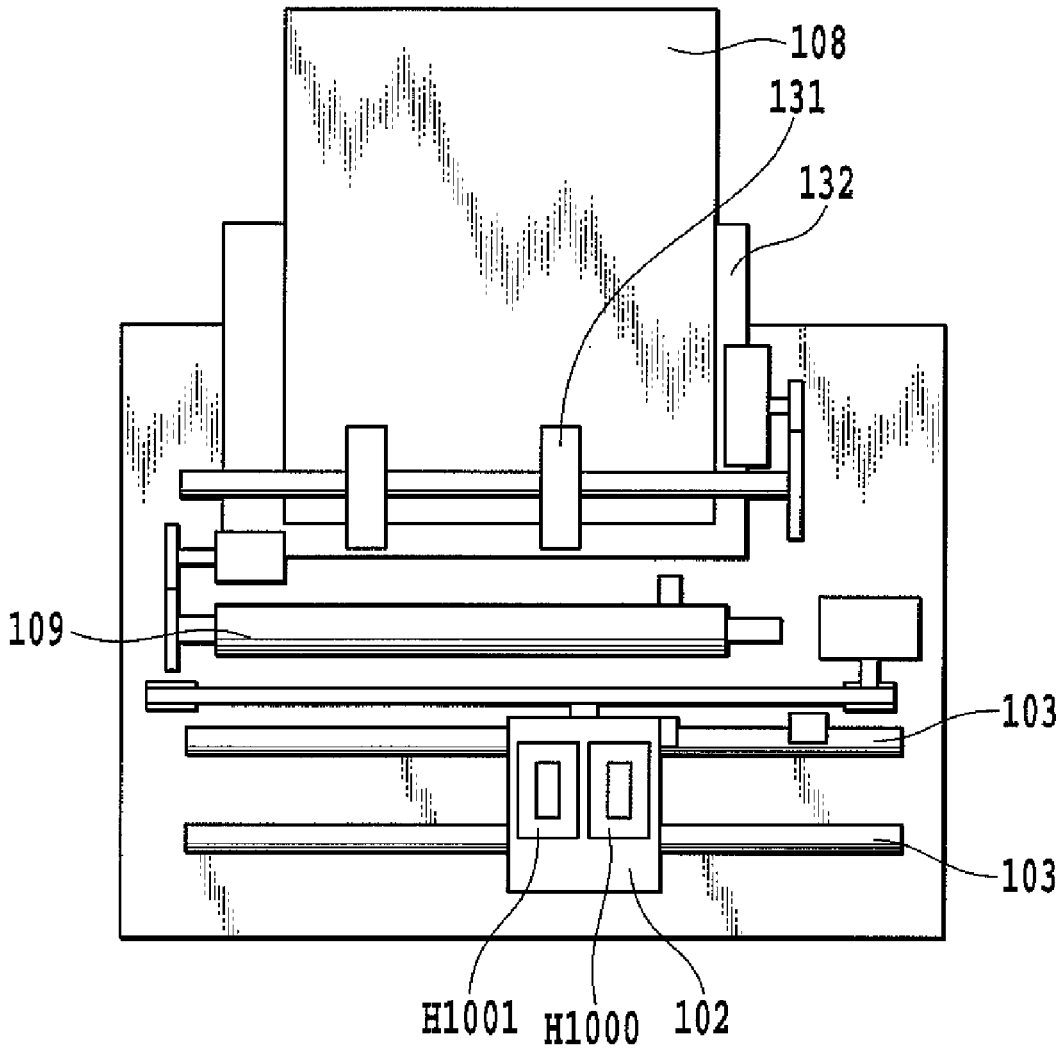
FIG. 1 is a schematic plan view showing one example of an ink jet printing apparatus, to which the present invention is applicable.

FIG. 1 is a plan view schematically showing one example of an ink jet printing apparatus where the present invention is applicable. This printing apparatus has a carriage 102 for detachably mounting printing heads H1000 and H1001. The carriage 102 is provided with electrical connection portion for transmitting drive signals and the like to ejecting portions via external signal connection terminals on the printing heads H1000 and H1001 in the carriage 102.

The carriage 102 is supported so as to reciprocally move along a guide shaft 103 installed in a main body of the apparatus and extended in a main scan direction.

A print medium 108 made of paper, plastic thin plate and the like is fed one by one from an auto sheet feeder (ASF) 132 by a pick up roller 131. Furthermore, the print medium 108 is conveyed (sub-scanned) passing a position (print area) opposing a surface (ejection face) where ejection openings of the printing heads H1000 and H1001 are formed, by a conveying roller 109.

The printing heads H1000 and H1001 mounted on the carriage 102 are held so that their ejection faces become parallel to the print medium 108, and are main-scanned on the print area.

The printing heads H1000 and H1001 are mounted on the carriage 102 so that an arrangement direction of the ejection openings in each ejecting portion coincides with a direction (for example, sub-scan direction) intersecting the main scan direction of the carriage 102. By ejecting ink from columns of these ejection openings during the main scanning, printing in a width corresponding to a range of ejection opening arrangement is performed.

2. Configuration Example of Ink Jet Printing Head

A first printing head H1000 and a second printing head H1001 are used in the present embodiment. Each printing head is formed by inseparably integrating ink tank(s). The first printing head H1000 has an ink containing portion filled with black ink and the ejecting portion for ejecting black ink supplied from this ink containing portion. The second printing head H1001 has ink containing portions filled with color inks (cyan ink, magenta ink, yellow ink) and ejecting portions for ejecting the respective color inks supplied from the respective ink containing portions. Each of the printing heads H1000 and H1001 is fixedly supported on the carriage 102 by positioning means and an electrical contact point and in a form of a cartridge attachable/detachable to/from the carriage. The printing head can be replaced when the filled ink is used up.

Out of the printing heads H1000 and H1001 used in the embodiment, a configuration of the printing head H1001 for color inks will be described by referring to FIGS. 2 to 4. As for the printing head H1000, its description will be omitted since it can adopt a similar configuration to that of the printing head 1001 apart from the fact that the configuration is only for one color, i.e., black ink.

Figure 2:
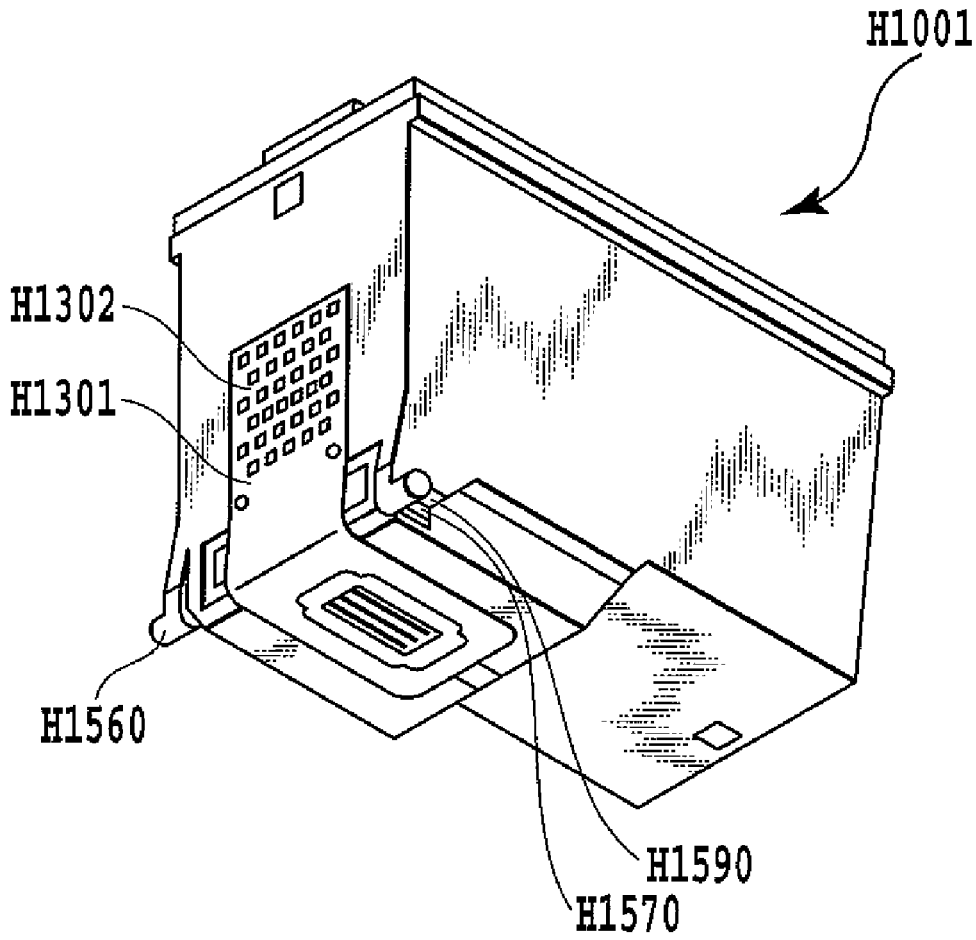
FIG. 2 is a perspective view showing a configuration example of a printing head mountable on the ink jet printing apparatus of FIG. 1, and shows a state viewed from a bottom side of the printing head.
Figure 3A:
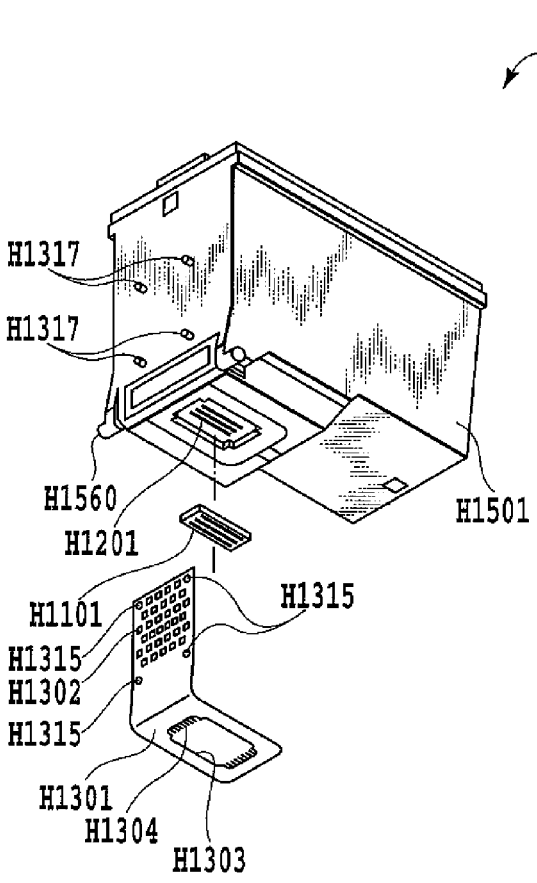
FIGS. 3A and 3B are exploded perspective views showing an internal configuration example of the printing head shown in FIG. 2, and respectively show states viewed from a bottom side of the printing head, and from a top side thereof.
Figure 3B:
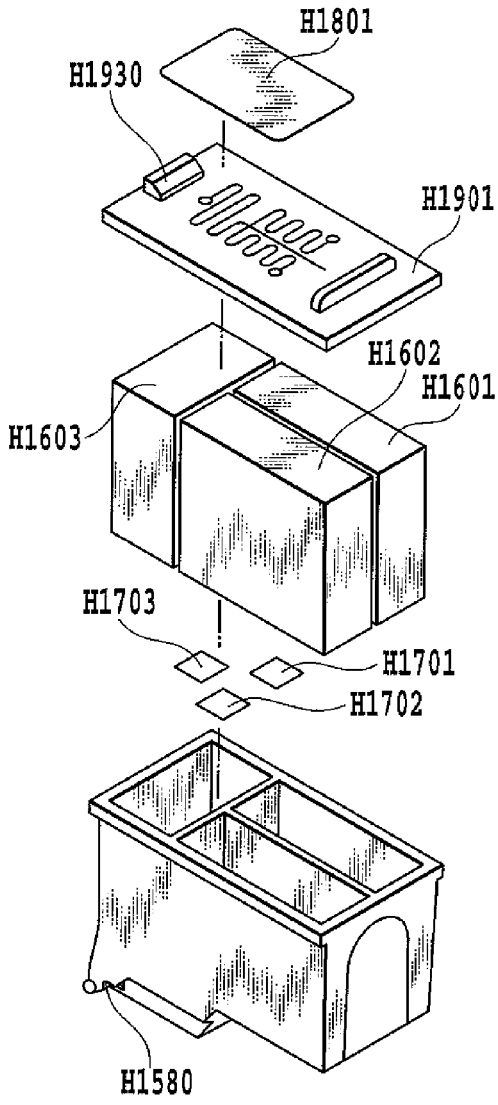

FIG. 2 is a perspective view showing a configuration example of the printing head 1001, which is possible to be mounted on the printing apparatus in FIG. 1, and FIGS. 3A and 3B are exploded perspective views thereof.

The printing head H1001 is provided with a mounting guide H1560, the engaging portion H1930, and abutting portions H1570, H1580, and H1590. The mounting guide H1560 is for guiding the printing head H1001 to a mounting position of the carriage 102 in the main body of the ink jet printing apparatus. The engaging portion H1930 is for mounting and fixing the printing head H1001 onto the carriage by engaging with a fixed lever (not illustrated) provided in a carriage side. The abutting portions H1570, H1580, and H1590 are for positioning the printing head H1001 in a predetermined mounting position of the carriage. The abutting portions H1570, H1580, and H1590 carry out positioning in an X-direction (main scan direction), a Y-direction (sub-scan direction), and a Z-direction (vertical direction), respectively. An electrical contact between the external signal connection terminal H1302 in the electric wiring tape H1301 and a contact pin of an electrical connection portion provided in the carriage becomes possible by being positioned in the carriage 102 by these abutting portions.

The printing head H1001 is for ejecting three colors of ink, i.e. cyan, magenta, and yellow, and configured as shown in the exploded perspective view in FIG. 3. In other words, the head has a print element substrate H1101, an electric wiring tape H1301, an ink containing and supplying member H1501, filters H1701, H1702, and H1703, ink absorbers H1601, H1602, and H1603, a cover member H1901, and a seal member 1801. Out of these, principal constituents will be described below.

1) Print Element Board

Figure 4:
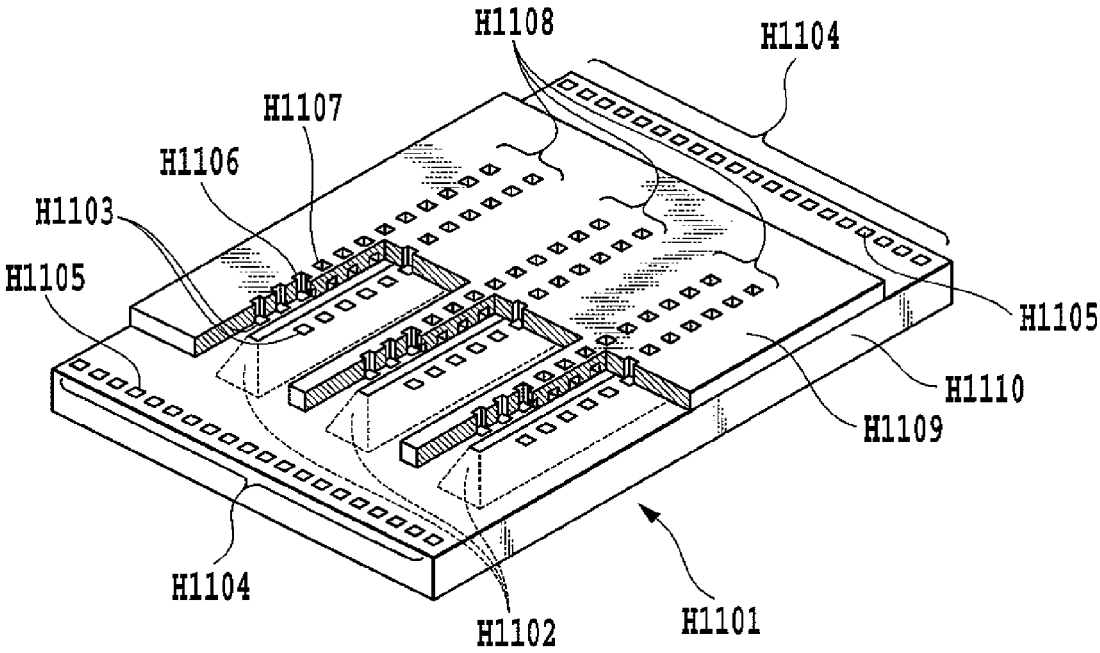
FIG. 4 is a perspective view showing a configuration example of a print element unit provided on the printing head shown in FIG. 2.

FIG. 4 is a partially cutaway perspective view for explaining a configuration of the print element substrate H1101. The print element substrate in the present embodiment is configured by use of electrothermal transducer elements which generate thermal energy for causing film boiling in ink in response to electrical signals. Additionally, the print element substrate assumes a configuration where the electrothermal transducer elements are arranged so as to face the respective ink ejection openings, and ink is ejected in a direction perpendicular to a main plane of the substrate.

As shown in FIG. 4, the print element substrate H1101 is configured by forming three long hole-shaped ink supply ports H1102 for three color inks of cyan, magenta, and yellow in parallel on an Si base H1110. An array of electrothermal transducer elements H1103 for generating thermal energy to cause film boiling in ink in response to electrical signals is arranged at each side of the ink supply port H1102. Two arrays of the electrothermal transducer elements are placed in a staggered manner by shifting a half arrangement pitch in the arrangement direction, that is, the sub-scan direction. Ejecting portions H1108 for each color is configured on this print element substrate H1101 by joining an ejection opening forming member on which ink passage walls H1106 and ejection openings H1107 are formed by applying a photolithography technique to resin materials, while aligning each electrothermal transducer element with each ejection opening. The printing head with such a configuration ejects ink in a vertical direction to a surface of the print element substrate.

Electric wirings, a fuse, logic circuits, a temperature sensor, an electrode portion H1104 and the like are formed on the Si base H1110. The electric wirings are for supplying power to the electrothermal transducer elements H1103 and are formed from Al and the like. The logic circuits are for driving the electrothermal transducer elements in response to printing data. These portions are electrically connected with the outside by the electrode portion H1104. Furthermore, a bump H1105 made of Au and the like is formed on each of electrodes in the electrode portion H1104. Note that the electrothermal transducer elements H1103 and the like can be formed using existing film-forming techniques.

Note that elements which generate energy utilized for ejecting ink are not limited to the electrothermal transducer elements which generate thermal energy for causing thermal foaming of ink in response to energization, and may be other than the electrothermal transducer elements. Additionally, the print element substrate may assume a configuration where ink is ejected in a direction parallel to the main plane of the substrate on which the electrothermal transducer elements are arrayed.

2) Electric Wiring Tape

The electric wiring tape H1301 as an electric wiring member forms an electrical signal path through which electrical signals for ejecting ink are applied to the print element substrate H1101. In the electric wiring tape H1301, an opening portion for incorporating the print element substrate H1101 is formed, and electrode terminals H1304 connected to the electrode portion H1104 of the print element substrate H1101 are formed in the vicinities of edges of this opening portion. Additionally, external signal connection terminals H1302 for receiving electrical signals from the main body of the apparatus are formed on the electric wiring tape H1301. The electrode terminals H1304 are connected to the external signal connection terminals H1302 by a conductive wiring pattern including continuous copper foils and the like. Here, the electric wiring tape H1301 is formed by using a TAB tape, and has a configuration where the conductive member is exposed through an end section H1311 as has been described above.

Electrical connection between the electric wiring tape H1301 and the print element substrate H1101 is established by, for example, connecting the bumps H1105, which are formed on the electrode portion 1104 of the print element substrate H1101, to the electrode terminals H1304 of the electric wiring tape H1301 which correspond to the electrode portion H1104 of the print element substrate H1101 by applying thermal ultrasonic compression bonding thereon. These locations are appropriately sealed.

3) Main Body Member

The main body member H1501, as a supporting member supporting the print element substrate H1101 which constitutes an ejection portion, and supporting the electric wiring tape H1301 which is an electric wiring member, is formed by resin molding.

The main body member H1501 in the embodiment is provided with an ink tank function and an ink supply function. That is, as shown in FIG. 3B, the main body member H1501 realizes the ink tank function by having a space for independently housing each of the ink absorbers H1601, H1602 and H1603 for generating negative pressures in order for the respective absorbers to internally retain the inks of cyan, magenta, and yellow. On the other hand, the main body member H1501 realizes the ink supply function by incorporating a passage member (not illustrated) independently forming each of ink supply passages for introducing ink to the respective ink supply openings H1102 on the print element substrate H1101.

An ink supply port H1201 for supplying each cyan, magenta, and yellow ink to the print element substrate H1101 is formed in downstream of the ink passage. The print element substrate H1101 is adhered and fixed to the ink containing and supplying member H1501 with high accuracy of position so that each of the ink supply ports H1102 on the print element substrate H1101 communicates with each of the ink supply ports H1201 of the ink containing and supplying member H1501.

Moreover, a back surface of a part of the electric wiring tape H1301 is adhered and fixed to a plane in a periphery near the ink supply ports H1201 by a second adhesive agent. A part electrically connecting a second print element substrate H1101 and the electric wiring tape H1301 is sealed by first and second sealants, so that the electrically connected part is protected from corrosion by ink or external impacts. The first sealant mainly seals a reverse side of a connecting portion between the electrode terminal H1304 in the electric wiring tape 1301 and the bump H1105 on the print element substrate, and a circumferential part of the print element substrate, while the second sealant seals an obverse side of the connecting portion.

On the other hand, an unadhered part, i.e., a side of the area where the external signal connection terminals H1302 are arranged, of the electric wiring tape H1301 is bent along a side surface perpendicular to a surface, which has the ink supply ports H1201, of the main body member H1501. Then, pins H1317 are inserted in holes H1315 provided respectively in several locations, e.g., at four corners, around the area, and the unadhered part is fixed by heat caulking.

3. Characteristic Configurations

Descriptions will be given for characteristic configurations preferably applied to the aforementioned basic configuration.

1) First Embodiment

Figure 5A:
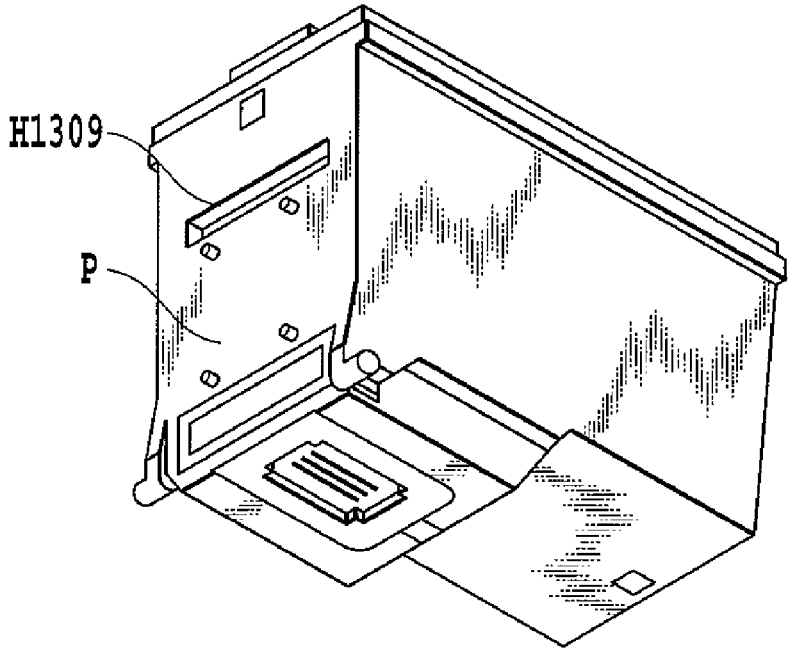
FIGS. 5A and 5B are perspective views showing a first embodiment of a preferable characteristic configuration of the present invention, and respectively show: a main body member before being assembled into a printing head; and the printing head assembled by using the main body member.
Figure 5B:
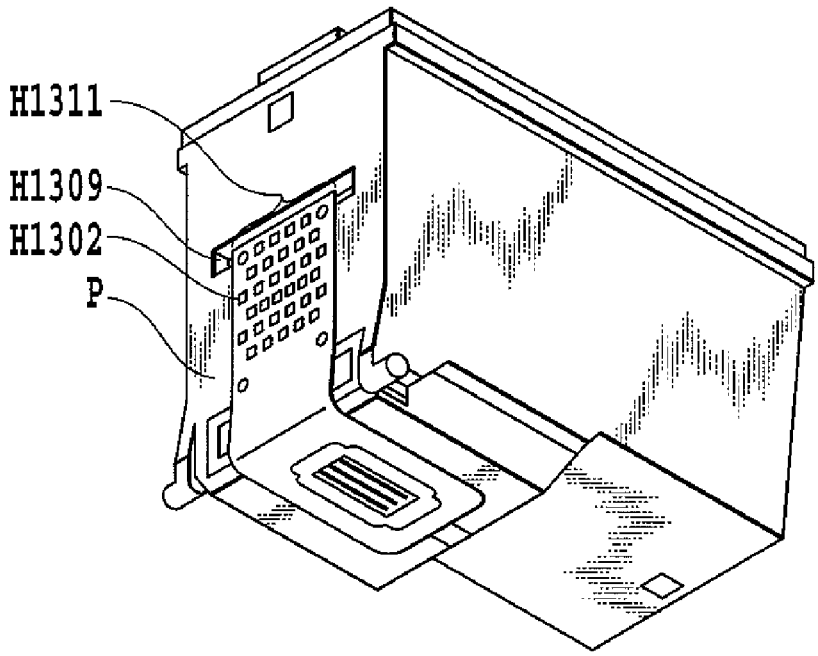

FIGS. 5A and 5B are perspective views showing a first embodiment of the preferable characteristic configuration, and respectively show: the main body member H1501 before being assembled into the printing head H1001; and the printing head H1001 assembled by using the main body member. As shown best in these drawings, in a location of the main body member H1501 where the end section H1311 of the electric wiring tape H1301 is located, a concave portion H1309 forming an opening extending in a width direction of the electric wiring tape H1301 is provided on a surface of the location.

In this case, as shown in FIG. 5B, the end section H1311, through which the electric wiring tape H1301 is externally exposed, projects into an area above the concave portion H1309 over a surface P by which the main body member H1501 supports the electric wiring tape H1301.

Here, the external signal connection terminals H1302 are parts abutted by contact pins of the carriage 102, and it is strongly desired that highly reliable abutting force is secured so as to prevent a contact failure. However, with presence of the concave portion H1309 on a back surface side of the area where the external signal input terminals H1302 are provided, there can be a case where necessary and sufficient abutting force is not available. Accordingly, the concave portion H1309 is provided on a side above the area where the external signal input terminals H1302 are provided.

The concave portion H1309 may be formed by, for example, partially thinning a wall thickness of the main body member H1501. In this case, with respect to a depth (in the Y-direction) of the concave portion H1309, it is desirable that the depth be a value determined in consideration of a gas barrier property relating to evaporation of ink in the main body member. In the present embodiment, while the wall thickness of the main body member is set to about 2 mm, the depth of the concave portion H1309 is set to 0.8 mm. However, this is only exemplification, and it is obvious that the depth can be determined as appropriate in consideration of various conditions.

Additionally, in the present embodiment, an opening width in the X-direction of the concave portion H1309 is made wider than a width of the electric wiring tape H1301 for the purpose of blocking access of liquid to the end section H1311 of the electric wiring tape H1301. However, as long as the access of liquid can be effectively blocked, the opening width of the concave portion H1309 may be made substantially as wide as the width of the electric wiring tape H1301. It suffices that the opening width be at least a width corresponding to a range where a wiring is externally exposed through the end section H1311 of the electric wiring tape H1301.

Furthermore, with respect to a height in the Z-direction of the concave portion H1309, the higher height is preferable. However, the external signal connection terminals H1302 are located in the vicinity of the end section H1311 of the electric wiring tape H1301. The external signal connection terminals H1302 are parts abutted by the contact pins of the electrical connection portion provided to the carriage 102. Accordingly, it is preferable that the height be determined as appropriate in consideration of a tolerance and the like, and be determined as appropriate further in consideration of the gas barrier property.

Figure 6A:
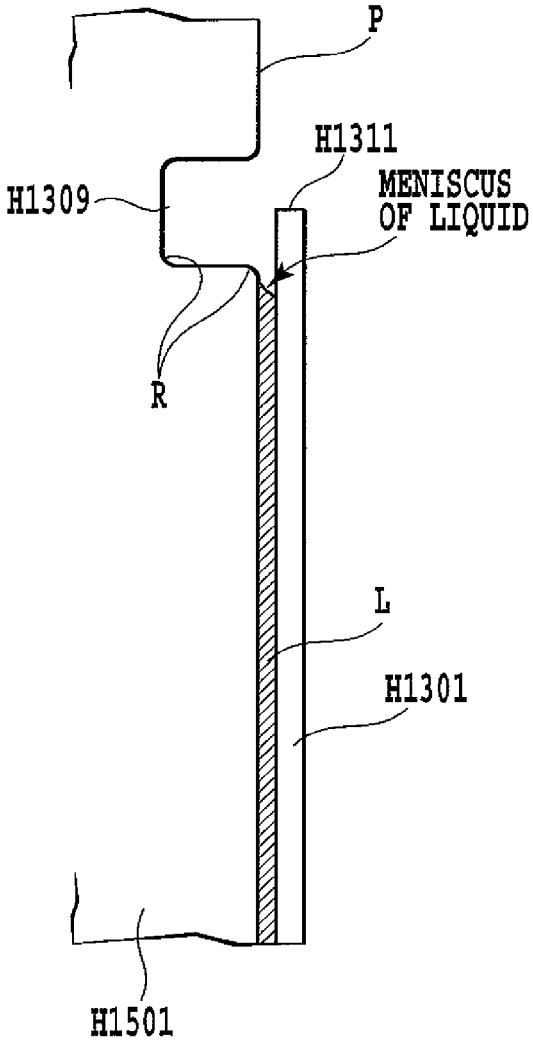
FIGS. 6A and 6B are schematic side cross-sectional views each for explaining behavior of liquid moving along a back surface of an electric wring member attached to a recording head, respectively in a case of the first embodiment, and in a conventional case.
Figure 6B:
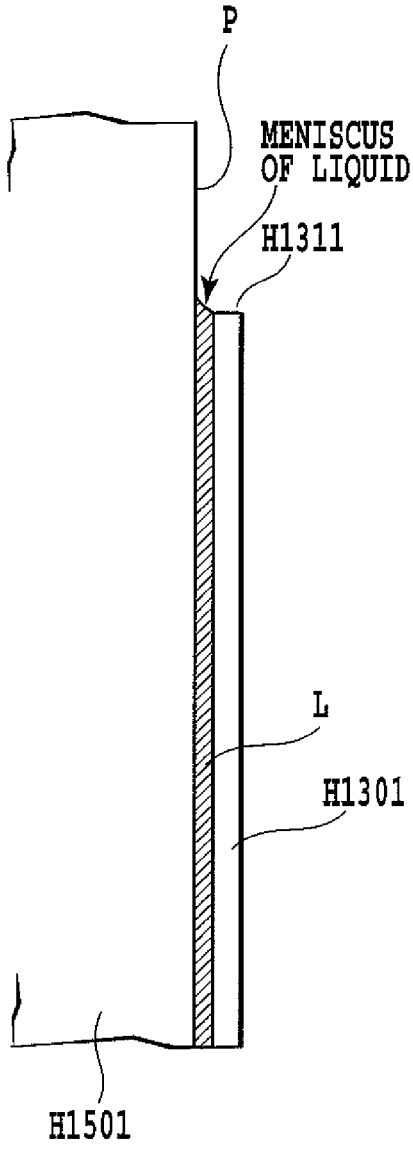

FIGS. 6A and 6B are side cross-sectional views showing the vicinities of the end sections H1311, through which the wiring is externally exposed, of the electric wiring tape H1301. FIG. 6A shows a case of the present embodiment, and FIG. 6B shows a conventional case.

As has been described above, there are cases where water drops are attached on the side surfaces of the main body member as a result of generation of dew condensation due to environmental variation, and where, ink drops are attached on the side surfaces of the main body member due to accumulation of ink mist and the like. In these cases, due to capillary force, liquid, such as ink and water drops, moves through a gap between a supporting surface of the main body member and a supported surface of the electric wiring tape H1301, and may possibly spread out along the area on the main body member where the electric wiring tape is arranged.

At this time, in a conventional configuration, as shown in FIG. 6B, liquid L moves to a location of the end section H1311 of the electric wiring tape H1301 due to capillary force, and makes contact with the wiring exposed through the end section H1311 by forming a meniscus in that location. Thus, there arises a risk of causing an electrical trouble such as corrosion of the wiring.

In response to this problem, in a configuration of the present embodiment, as is apparent from FIG. 6A, the end section H1311 of the electric wiring tape H1301 is located above the concave portion H1309. The liquid L moves due to capillary force, reaches the concave portion H1311, and forms a meniscus therein. Accordingly, movement of the liquid L reaching the end section H1311, through which the wiring is externally exposed, is blocked, whereby it is made possible to provide a highly reliable ink jet printing head free from electrical trouble.

Note that, in the configuration shown in FIG. 6A, ridge portions connecting the opening portion of the concave portion H1309 to the electric wiring tape supporting surface P, and ridge portions connecting side surfaces of the concave portion H1309 to a bottom surface (a surface on the innermost side) thereof, are formed into shapes of curved surfaces.

Figure 7:
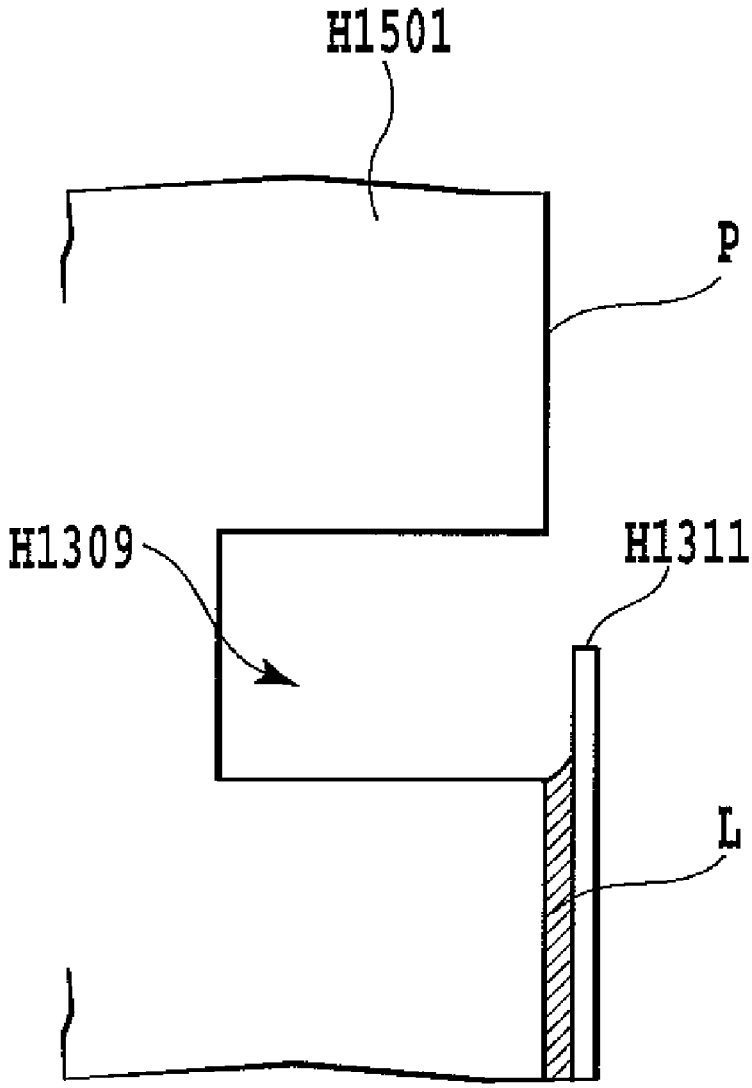
FIG. 7 is a schematic side cross-sectional view for explaining behavior of liquid in a case of using a concave portion, which has a lateral cross-sectional shape different from that in the FIG. 6A.

As shown in FIG. 7, when the opening portion of the concave portion H1309 is formed into an edged shape, the liquid does not readily form a meniscus there, and a position where a meniscus is formed may possibly be included in the concave portion H1309. Depending on situations, therefore, there is a case where the liquid intrudes into an inside of the concave portion H1310. When this state occurs, there arises a risk of causing the liquid, which has intruded therein, to make contact with the end section H1311. Accordingly, as shown in FIG. 6A, forming the ridge portion of the concave portion H1310 and the like into the curved shapes facilitates formation of a meniscus, and is more effective in blocking movement of the liquid beyond the ridge portions.

In this case, it is desirable to appropriately determine the shapes of the curved surfaces, as well as the dimensions, of the ridge portions in order to make a meniscus force of the liquid in the ridge portions of the concave portion H1310 larger than a water head pressure of the liquid lifted up to the concave portion H1309, the water head pressure being caused by an orientation of the printing head H1001.

Additionally, in the present embodiment, the concave portion H1309 is configured to be one in a substantially rectangular cross-sectional shape formed of two side surfaces and a bottom surface. However, any shape is applicable if the shape is recessed inward appropriately from the electric wiring tape supporting surface P, as long as it satisfies preferable conditions with regard to dimensions. For example, the shape may be a triangular shape or a semicircular shape, or may be a stepped shape where a part inwardly concave from the electric wiring tape supporting surface P extends to an upper edge portion of the main body member H1501. That is, the cross-sectional shape is not limited to the illustrated one, and is applicable if the shape allows the end section H1311 to project appropriately.

Furthermore, as an effect of providing the concave portion, the following can be included.

For example, when connection with contact pins on the part of the carriage 102 is performed in a state where liquid exists on a back surface of the area where the electrical signal input terminal portion is provided, there is a case where the liquid on the back surface of the electrical signal input terminal portion is pushed out due to a pressure received from the contact pins. In a configuration where the concave portion H1309 of the present embodiment is not provided, the liquid, which has been pushed out to the main surface P of the main body member H1501, flows round to the front surface side of the electric wiring tape. Subsequently, if the liquid flows down and reaches the electrical signal input terminal portion, there arises a concern that a situation may come to a point where an electrical short circuit occurs. This is also a problem presented even in a case where an electrical wiring tape through an end portion of which a conductive member is not exposed. In contrast, according to the configuration of the present embodiment, because the liquid pushed out is accepted by the concave portion H1309, a risk for such trouble to occur can be reduced.

2) Second Embodiment

Figure 8A:
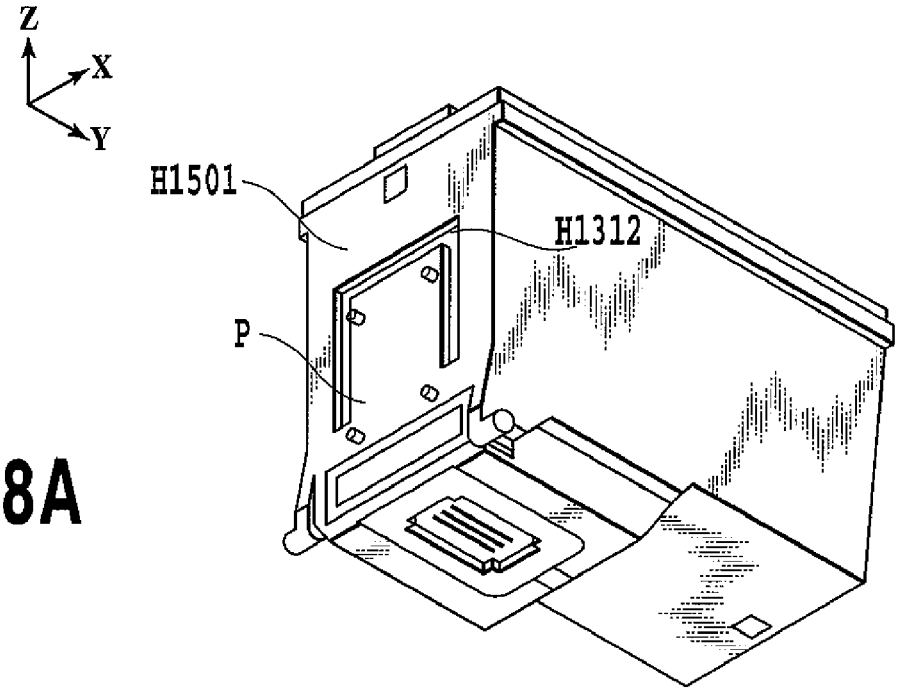
FIGS. 8A and 8B are perspective views showing a second embodiment of a preferable characteristic configuration of the present invention, and respectively show: a main body member before being assembled into a printing head; and the printing head assembled by using the main body member.
Figure 8B:
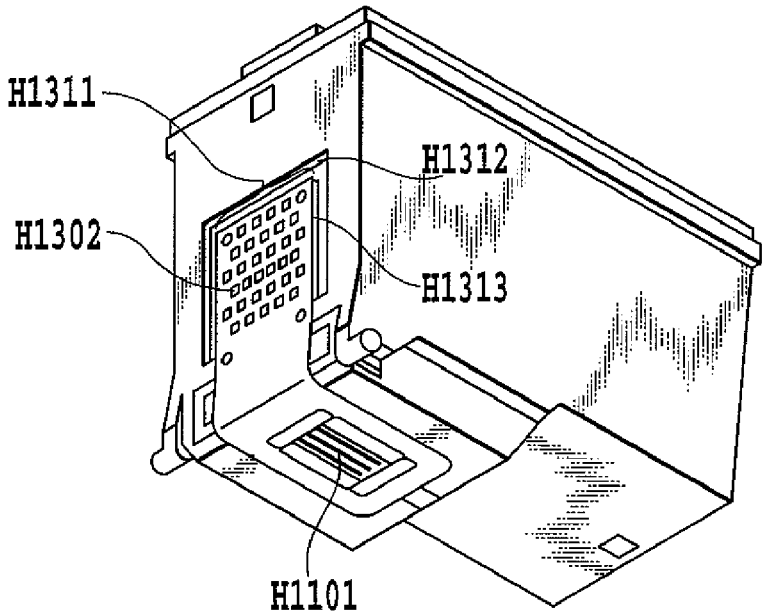

FIGS. 8A and 8B are perspective views showing a second embodiment of the preferable characteristic configuration, and respectively show: the main body member H1501 before being assembled into the printing head H1001; and the printing head H1001 assembled by using the main body member.

In the main body member H1501 according to the present embodiment, as shown in FIG. 8A, a substantially U-letter shaped concave portion H1312 is provided. This portion is formed of: a portion extending along the end section H1311 of the electric wiring tape H1301 (a portion corresponding to the concave portion H1309 of the first embodiment); and portions extending respectively along both side surfaces of the electric wiring tape H1301. That is, the end section H1311 of the electric wiring tape H1301 and both of the side sections of the electric wiring tape H1301 are configured to project over the substantially U-letter shaped concave portion H1312.

For a cross-sectional shape of the concave portion H1312, as in the case with the previous embodiment, it is desirable that ridge portions connecting an opening portion of the concave portion H1312 to the electric wiring tape supporting surface P, and portions connecting side surfaces thereof to a bottom surface (a surface on the innermost side) thereof, be formed into shapes of curved surfaces. Additionally, also with respect to dimensions of each portion of the concave portion H1312, the dimensions can be determined as appropriate in consideration of the same issues described regarding the abovementioned first embodiment.

Here, as has been described above, the electric wiring tape H1301 is formed by being processed into desired shape and dimensions by, for example, punching a TAB tape matrix. If there has been deformation, such as warpage, generated on a side section H1313 of the electric wiring tape H1301 in association with the processing, it causes capillary force between this deformed portion and the supporting surface P of the main body member, whereby it is made easier for liquid to move upward along the side section H1313. In particular, because the side section H1313 extends to an end section on the part of the print element substrate H1101, it is made easier for the side section H1313 to introduce ink generated in association with the abovementioned recovery operations.

In contrast, in the present embodiment, the side surface H1313 of the electric wiring tape H1301 projects over the concave portion H1312, and neither faces nor abuts the main surface P of the main member portion H1501. Accordingly, liquid is made less prone to move along the side section H1313.

Moreover, liquid moving through a gap between the supporting surface of the main body member and the supported surface of the electric wiring tape is blocked off by a portion of the concave portion H1312 extending along the end section H1313 of the electric wiring tape H1301, the liquid including ink generated in association with the recovery operations.

As has been described above, according to the present embodiment, movement of the liquid coming to the end section H1311 through which the wiring is externally exposed is blocked further effectively, whereby it is made possible to provide a highly reliable ink jet print head free from electrical trouble.

Additionally, in the present embodiment, the concave portion is formed not only in a location corresponding to the end section H1312 of the electric wiring tape H1301, but also in locations corresponding to the side section H1313 thereof. Accordingly, when connection with the contact pins on the part of the carriage 102 is performed in a state where liquid exists on a back surface of the area where the electrical signal input terminal portion is provided, it is made possible to suppress all the more effectively such trouble that the liquid pushed out flows round to the front surface side of the electric wiring tape.

3) Third Embodiment

In the abovementioned first embodiment, the concave portion is provided to a location where the end section H1312 of the electric wiring tape H1301 projects. However, the concave portion can be provided to any location as long as the location is capable of blocking movement of liquid.

Figure 9A:
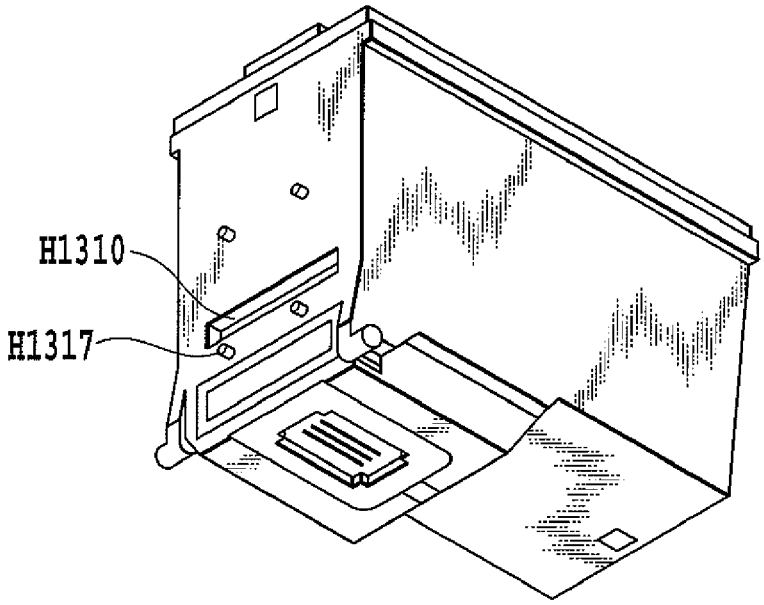
FIGS. 9A and 9B are perspective views showing a third embodiment of a preferable characteristic configuration of the present invention, and respectively show: a main body member before being assembled into a printing head; and the printing head assembled by using the main body member.
Figure 9B:
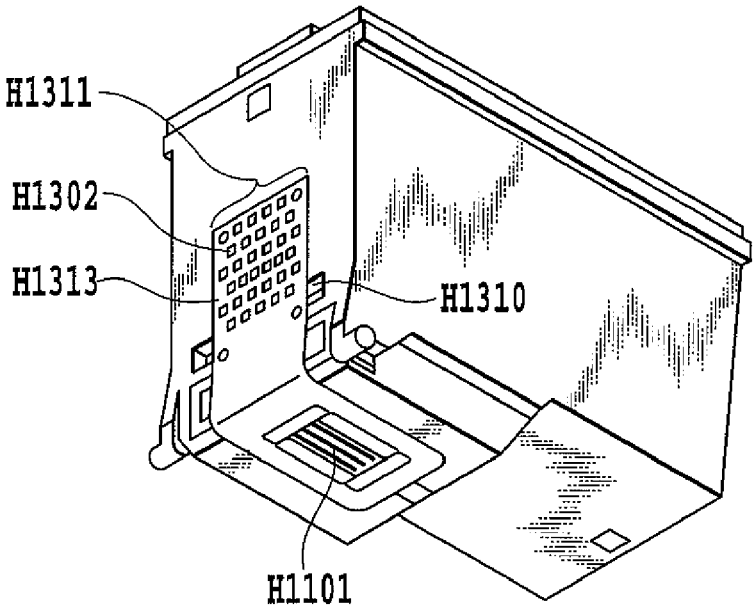

FIGS. 9A and 9B are perspective views showing a third embodiment of the preferable characteristic configuration, and respectively show: the main body member H1501 before being assembled into the printing head H1001; and the printing head H1001 assembled by using the main body member.

The concave portion H1310 according to the present embodiment, as shown in FIGS. 9A and 9B, is provided below a location corresponding to an area where the external signal connection terminals H1302 of the electric wiring tape H1301 are provided. As has been described above, liquid is generated due to various factors. In response to this problem, in the present embodiment in particular, the concave portion H1310 is configured to block movement of ink on the part of the print element substrate H1101 due to capillary force, the ink having been generated in association with the recovery operations. Thereby, the ink is prevented from lifting up to the back surface side, which is located below the end section H1311, of the area where the external signal input terminals H1302 are provided.

Here, the external signal connection terminals H1302 are parts abutted by the contact pins of the carriage 102, and it is strongly desirable that highly reliable abutting force be secured so as to prevent a contact failure. However, with presence of the concave portion H1310 on the back surface side of the area where the external signal input terminals H1302 are provided, there can be a case where necessary and sufficient abutting force is not available. Accordingly, the concave portion H1310 is provided below the location corresponding to the area where the external signal input terminals H1302 are provided.

Figure 10A:
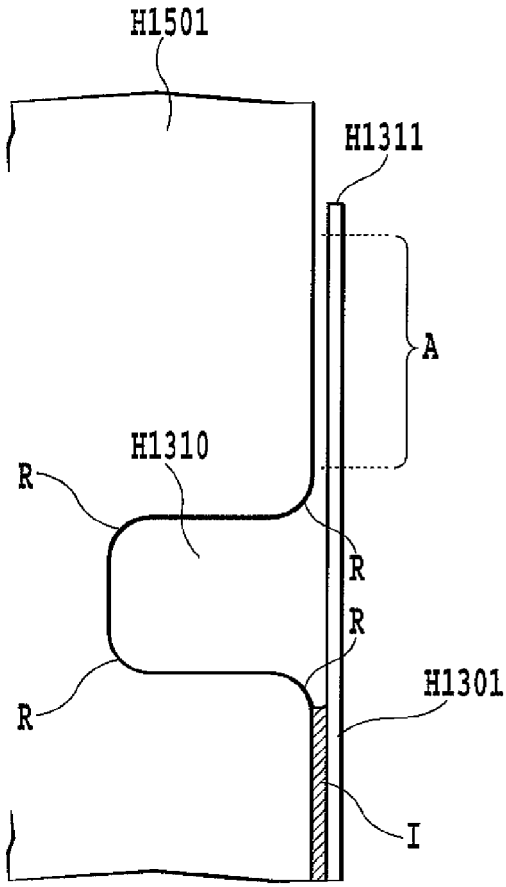
FIGS. 10A and 10B are schematic side cross-sectional views each for explaining behavior of liquid moving along a back surface of an electric wring member attached to a recording head, respectively in a case of the third embodiment, and in a conventional case.
Figure 10B:
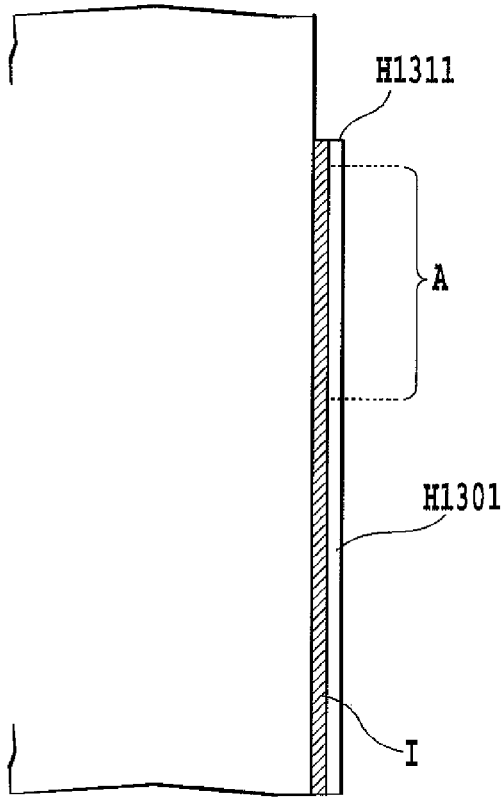

FIGS. 10A and 10B are side cross-sectional views showing the vicinity of the concave portion H1310, respectively in a case of the third embodiment, and in a conventional case.

As has been described above, ink generated in association with the recovery operations and located on the side of the print element substrate H1101 may possibly move through a gap between the supporting surface of the main body member and the supported surface of the electric wiring tape H1301 due to capillary force.

At this point, in a conventional configuration, as shown in FIG. 10B, ink I goes through the back side of the area A where the external signal connection terminals H1302 are provided, and moves further to the location of the end section H1311 of the electric wiring tape H1301. Thereby, there is a risk that the ink may make contact with the end section H1311 through which the wiring is exposed.

In contrast, in the configuration of the present embodiment, as is apparent from FIG. 10A, the ink is blocked off completely by the concave portion H1310 before it reaches the end section H1311 of the external signal input terminals H1302. Moreover, because parts of the side sections H1313 of the electric wiring tape H1301 are located on the concave portion H1310, the ink is made less prone to move along the side surfaces H1313, as in the case with the second embodiment.

Additionally, in the case of the present embodiment, the ink generated in association with the recovery operations is blocked off by the concave portion H1310, and is thus prevented from lifting up to the back surface side of the area A where the external signal connection terminals H1302 are provided. Thereby, it is made possible to reduce an amount of liquid which can exist in a part on the back surface side. This configuration is effective in causing abutting force to preferably act, and in enhancing reliability of electrical connection compared with a case where connection with, for example, contact pins on the part of the carriage 102 is performed in a state where liquid exists on the back surface where the electrical signal input terminal portion is provided. Furthermore, as in the case with the previous embodiment, it is made possible to effectively suppress such trouble that the liquid, which has been pushed out due to the connection, flows round onto the front surface side of the electric wiring tape.

Note that, in order for the effect of the present embodiment to be more conspicuously exerted, it is desired that the electrical wiring tape H1301 abut the main body member H1501 in an area outside the concave portion H1310. For this reason, in the present embodiment, the concave portion H1310 is located between a position corresponding to the area of the external signal input terminals H1302, and portions (in the present embodiment, lower ones of the pins H1317 for heat caulking) where the electric wiring tape H1301 is fixed.

As in the case with the abovementioned first embodiment, a shape and dimensions of the concave portion H1310 can be determined as appropriate. In the present embodiment, however, it is desirable that a position and a height (in the Z-direction) of the concave portion H1310 be determined in consideration of preserving, at the time of heat caulking, a receiving surface, which is flush with the supporting surface P, around the pins H1317.

Additionally, it is strongly desired that the concave portion H1310 is provided so as to have an opening width (in the X-direction) thereof as wide as, or wider than, the width of the electric wiring tape H1301 when it is fixed to the main body member H1501. If the opening width of the concave portion H1310 is narrower than the width of the electric wiring tape H1301, there is generated a portion where a back surface of the electric wiring tape H1301 and an ink containing member H1501 abut or face each other. Even if dimensions of the portion are minute, ink moves due to capillary force. Generation of this portion is, therefore, undesirable because the portion makes it harder to obtain the effect of the present embodiment.

Furthermore, also in the configuration of the present embodiment, ridge portions connecting an opening portion of the concave portion H1310 to the electric wiring tape supporting surface P, and ridge portions connecting side surfaces of the concave portion H1310 to a bottom surface (a surface on the innermost side) thereof, are formed into shapes of curved surfaces.

Figure 11:
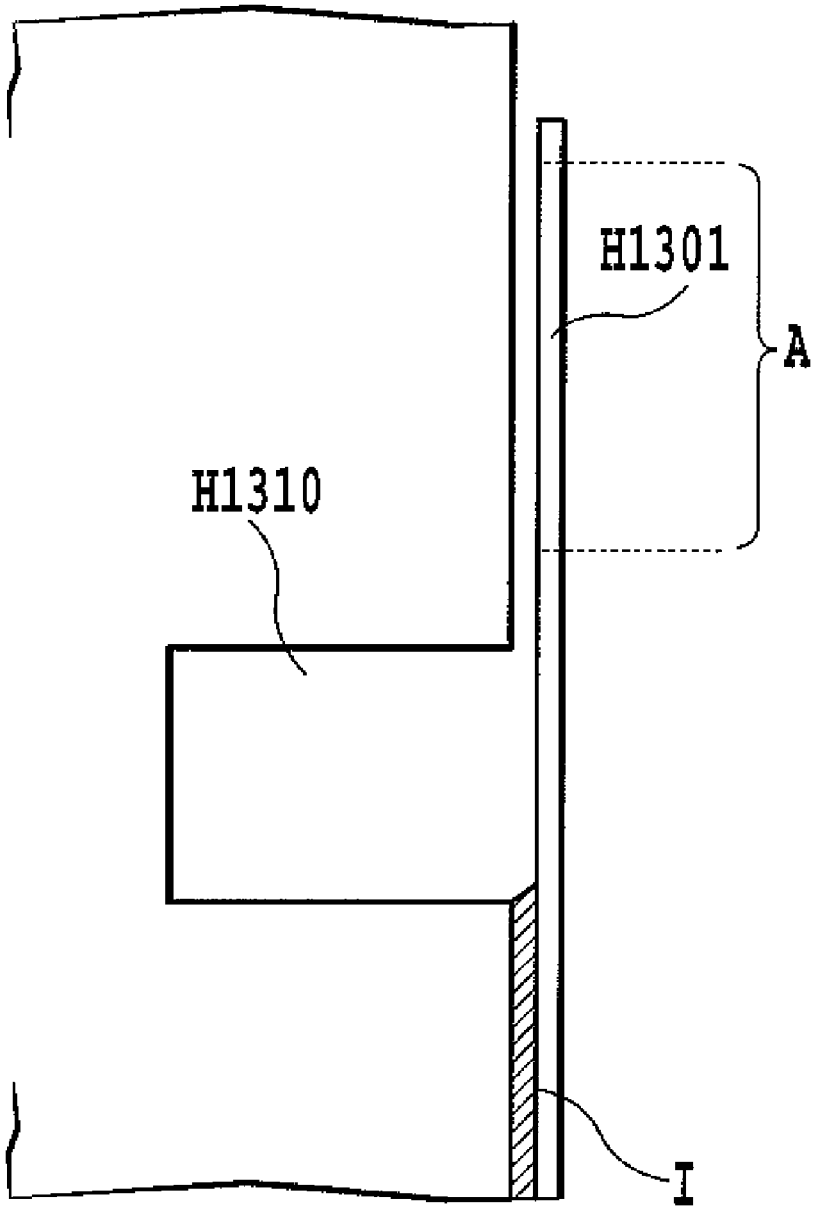
FIG. 11 is a schematic side cross-sectional view for explaining behavior of liquid in a case of using a concave portion, which has a lateral cross-sectional shape different from that in the FIG. 10A.

It can be considered that the opening portion of the concave portion H1310 is formed into an edged shape as shown in FIG. 11. In this case, however, ink does not readily form a meniscus there, and a location where the meniscus is formed may possibly be included in the concave portion H1310. Depending on situations, therefore, there is a case where ink intrudes into an inside of the concave portion H1310. It becomes harder to obtain the effect of the present embodiment in cases including a case where ink in an amount exceeding a capacity of the concave portion H1310 has moved, and a case where ink travels on the side surface of the concave portion H1310. Consequently, as shown in FIG. 10A, forming the ridge portion of the concave portion H1310 and the like into the shape of curved surfaces facilitates formation of a meniscus in the opening portion (an entrance of the concave portion H1310), and is more effective in blocking movement of ink beyond the ridge portions. Additionally, it is preferable that ridge line portions connecting the side surfaces of the concave portion H1310 to the bottom surface thereof be also formed of curved surfaces.

Also in the present embodiment, it is desirable to appropriately determine the shapes of the curved surfaces, as well as the dimensions, of the ridge portions in order to make a meniscus force of ink in the ridge portions of the concave portion H1310 larger than a water head pressure of ink lifted up to the concave portion H1310, the water head pressure being caused by an orientation of the printing head H1001.

Additionally, in the present embodiment, variations in the shape of the concave portion H1310 are also certainly made possible as in the case with the first embodiment.

4) Fourth Embodiment

A disposition location of a concave portion, and a number of the concave portions are not limited by the abovementioned various embodiments, and can be determined as appropriate without being limited by the abovementioned various embodiments. The configurations of the respective embodiments can also be combined. Here, an embodiment of this combination is shown.

Figure 12A:
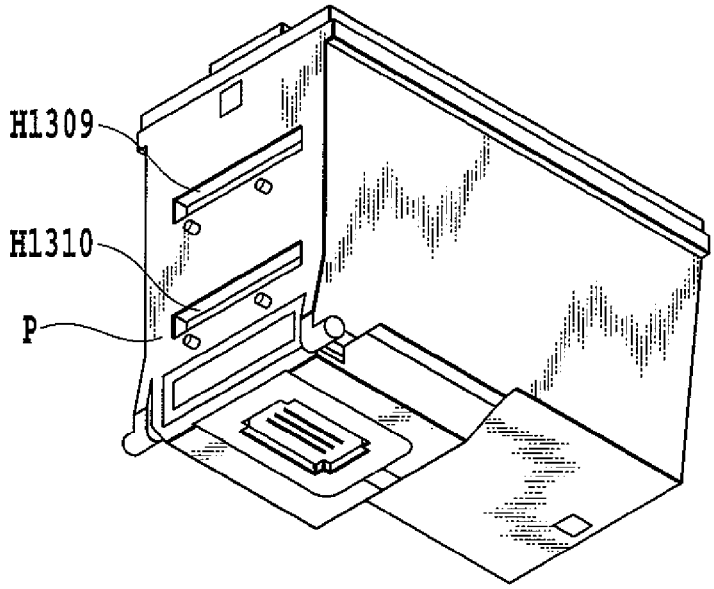
FIGS. 12A and 12B are perspective views showing a fourth embodiment of a preferable characteristic configuration of the present invention, and respectively show: a main body member before being assembled into a printing head; and the printing head assembled by using the main body member.
Figure 12B:
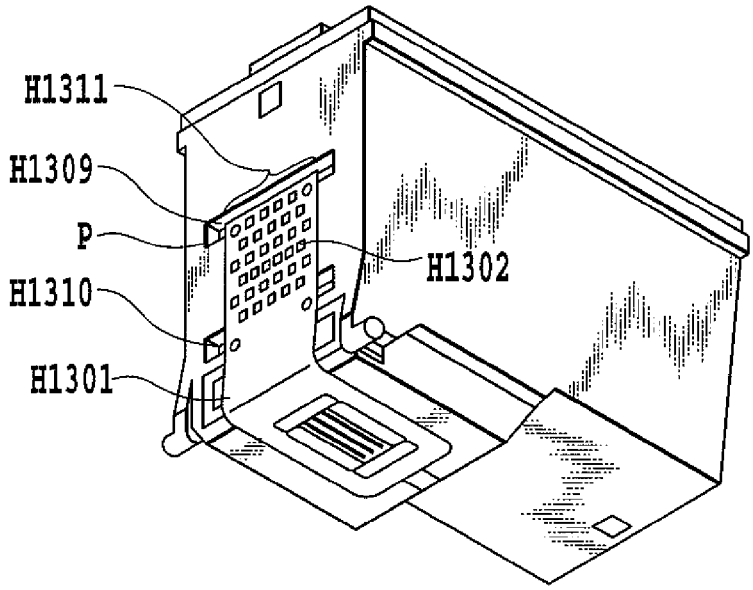

FIGS. 12A and 12B are perspective views showing a fourth embodiment of the preferable characteristic configuration of the present invention, and respectively show: the main body member H1501 before being assembled into the printing head H1001; and the printing head H1001 assembled by using the main body member.

The configuration of the present embodiment is one where both of the concave portion H1309 and the concave portion H1310 are provided to the main body member H1501. The concave portion H1309 is present in a location (a first location) on the side of the end section H1311, as has been described in the first embodiment. The concave portion H1310 is present in a location (a second location) in the vicinity of the lower contact pins as has been described in the third embodiment. According to such a configuration, movement of ink, which is generated in association with the recovery operations, and which is located on the side of the print element substrate H1101, is blocked by the concave portion H1310. On the other hand, movement of liquid, such as water drops and ink drops, existing on the back surface side of the area A where the external signal connection terminals H1302 are formed is blocked by the concave portion H1309. Consequently, according to the present embodiment, it is made possible to far more effectively prevent inconveniences caused by liquid reaching the locations of the end section H1311 of the electric wiring tape and the external signal connection terminals H1302.

4. Other Issues

Note that the above descriptions have been given for the various embodiments of configurations, to which the present invention is applied, the configurations being ones of the color-ink printing head H1001 which enables three colors of ink of cyan, magenta and yellow. However, it is obvious that the same configurations can be adopted for the printing head H1000 for black ink. Additionally, it goes without saying that kinds and a number of color tones (colors and density) of ink used in the printing head can be determined as appropriate.

Moreover, the above descriptions have exemplified the cases in each of which the present invention is applied to the printing head formed by integrating an ink containing portion therewith so that the printing head and the ink containing portion are inseparable. However, the object of the present invention is to effectively prevent inconveniences caused by access of liquid to the end section of the electric wiring member through which the conductive member is exposed, and to the location of the external signal connection terminals H1302. Accordingly, the present invention is effectively applicable to a printing head formed by detachably integrating an ink tank.

Furthermore, a configuration of the area where the concave portion H1309 or the concave portion H1310 is provided is not limited to a configuration where the electric wiring tape H1301 and the main body member H1501 are attached to each other without using an adhesive agent. The configuration may be for a case where, even after having been adhered by using the adhesive agent, a gap between the electric wiring tape H1301 and the main body member H1501 is generated due to incomplete adhesion of the two members.

According to any of the above embodiments, the opening provided on the supporting surface of the main body member of the printing head blocks movement of liquid, such as water drops and ink, which otherwise moves through a gap between the back surface of the electric wiring member and the supporting surface due to capillary force. Accordingly, it is made possible to provide a highly reliable ink jet printing head, which protects wirings and the like against electrical trouble, such as, most notably, corrosion generated by liquid reaching the end section of the electric wiring member through which the conductive member is exposed.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application Nos. 2005-200155 filed Jul. 8, 2005, and 2005-200154 filed Jul. 8, 2005 which are hereby incorporated by reference herein.

What is claimed is:

1. An ink jet printing head attachable to/detachable from an ink jet printing apparatus, comprising:

a print element board including ink ejection openings, elements which generate energy for ejecting ink from the ink ejection openings, and an electrode portion electrically connected with the elements;

an electric wiring tape provided with external signal connection terminals which make contact with connection terminals of the ink jet printing apparatus when the ink jet printing head is attached to the ink jet printing apparatus, terminals connected to the electrode portion, and a wiring for transmitting signals including drive signals for the elements by connecting the terminals and the external signal connection terminals, wherein a part of the wiring is exposed at an end section being located on a side of an area where the external signal connection terminals are disposed; and a supporting member, which supports the print element board and the electric wiring tape, wherein an external surface of the supporting member is provided with a concave portion, the end section of the electric wiring tape is located above the concave portion, and the area of the electric wiring tape where the external signal connection terminals are disposed is between the end section and the print element board and is supported by the supporting member, such that the external surface of the supporting member is provided beneath the area of the electric wiring tape where the external signal connection terminals are disposed and no part of the concave portion is positioned beneath the area of the electric wiring tape where the external signal connection terminals are disposed.

2. An ink jet printing head as claimed in claim 1, wherein the concave portion extends along the end section of the electric wiring tape, and in a range at least equal to a width of the electric wiring tape.

3. An ink jet printing head as claimed in claim 1, wherein the concave portion is provided outside a location corresponding to an area where the external signal connection terminals of the electric wiring tape are provided.

4. An ink jet printing head as claimed in claim 1, wherein ridge portions of the concave portion are formed of curved surfaces, the ridge portions connected to the external surface of the supporting member which supports the electric wiring tape.

5. An ink jet printing head as claimed in claim 1, wherein ridge portions, in which surfaces composing the concave portion are connected to one another, are formed of curved surfaces.

6. An ink jet printing head as claimed in claim 1, wherein the concave portion includes a portion extending along the end section of the electric wiring tape, and portions extending along side sections of the electric wiring tape.

7. An ink jet printing head as claimed in claim 1, wherein the wiring of the electric wiring tape is exposed through the end section of the electric wiring tape.

8. An ink jet printing head as claimed in claim 1, wherein the electric wiring tape is formed of a TAB tape.

9. An ink jet printing head as claimed in claim 1, wherein an area of the electric wiring tape where the external signal connection terminals are provided is fixed to a supporting surface of the supporting member without using an adhesive agent, the supporting surface being situated on a back surface of the area.

10. An ink jet printing head as claimed in claim 9, wherein the electric wiring tape has holes in plural locations around the area, the supporting member has pins protrusively provided so as to respectively correspond to the holes, and the fixing is carried out by performing heat caulking with the pins inserted into the holes.

11. An ink jet printing head as claimed in claim 1, wherein the supporting member integrally includes a portion containing ink.

* * * * *